US007431777B1

(12) United States Patent
Chun et al.

(10) Patent No.: US 7,431,777 B1
(45) Date of Patent: Oct. 7, 2008

(54) COMPOSITION GRADIENT CERMETS AND REACTIVE HEAT TREATMENT PROCESS FOR PREPARING SAME

(75) Inventors: ChangMin Chun, Belle Mead, NJ (US); Narasimha-Rao Venkata Bangaru, Annandale, NJ (US); Hyun-Woo Jin, Phillipsburg, NJ (US); Jayoung Koo, Bridgewater, NJ (US); John Roger Peterson, Ashburn, VA (US); Robert Lee Antram, Warrenton, VA (US); Christopher John Fowler, Springfield, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 102 days.

(21) Appl. No.: 10/829,818

(22) Filed: Apr. 22, 2004

Related U.S. Application Data

(60) Provisional application No. 60/471,992, filed on May 20, 2003.

(51) Int. Cl.
*C23C 8/00* (2006.01)

(52) U.S. Cl. ..... 148/206

(58) Field of Classification Search ..... 148/206
See application file for complete search history.

(56) References Cited

U.S. PATENT DOCUMENTS

| | | | | | |
|---|---|---|---|---|---|
| 1,804,176 | A | * | 5/1931 | McQuaid | 148/230 |
| 2,339,223 | A | * | 1/1944 | Holt | 148/218 |
| 2,454,020 | A | * | 11/1948 | Weitzenkorn et al. | 420/428 |
| 3,425,822 | A | * | 2/1969 | Lambert et al. | 75/351 |
| 3,562,024 | A | * | 2/1971 | Smith | 148/501 |
| 3,837,894 | A | * | 9/1974 | Tucker, Jr. | 427/419.2 |
| 4,040,870 | A | * | 8/1977 | Holzl | 148/241 |
| 4,047,981 | A | * | 9/1977 | Arnold et al. | 148/207 |
| 4,145,232 | A | * | 3/1979 | Solomon | 148/218 |
| 4,486,285 | A | * | 12/1984 | Aubert et al. | 204/192.15 |
| 4,568,393 | A | * | 2/1986 | Kane et al. | 148/220 |
| 4,582,679 | A | * | 4/1986 | Wilson et al. | 419/13 |
| 4,588,450 | A | | 5/1986 | Purohit | |
| 4,615,715 | A | * | 10/1986 | Seshamani | 55/434.4 |
| 4,680,908 | A | * | 7/1987 | Crowley | 52/378 |
| 4,707,384 | A | | 11/1987 | Schachner et al. | 427/249 |
| 4,713,122 | A | * | 12/1987 | Dawes et al. | 148/232 |
| 4,734,339 | A | | 3/1988 | Schachner et al. | 428/701 |
| 4,808,055 | A | | 2/1989 | Wertz et al. | 416/224 |
| 4,913,749 | A | * | 4/1990 | Hengerer et al. | 148/233 |
| 5,094,699 | A | * | 3/1992 | Feichtinger et al. | 148/207 |
| 5,102,538 | A | | 4/1992 | Weiergraber | 210/180 |
| 5,205,873 | A | * | 4/1993 | Faure et al. | 148/206 |
| 5,424,028 | A | * | 6/1995 | Maloney et al. | 420/38 |
| 5,599,404 | A | | 2/1997 | Alger | 148/212 |
| 5,630,887 | A | * | 5/1997 | Benum et al. | 148/280 |
| 5,820,707 | A | | 10/1998 | Amick et al. | 148/669 |
| 6,238,490 | B1 | * | 5/2001 | Bell et al. | 148/222 |
| 6,267,825 | B1 | | 7/2001 | Stall et al. | 148/237 |

FOREIGN PATENT DOCUMENTS

| | | | |
|---|---|---|---|
| CH | 641840 | A5 | 6/1977 |
| EP | 0105138 | | 7/1989 |
| GB | 398834 | | 9/1933 |
| JP | 61174324 | | 8/1986 |
| JP | 02294462 | | 12/1990 |
| JP | 06256886 | | 9/1994 |
| JP | 08319555 | | 12/1996 |
| JP | 09263906 | | 10/1997 |
| JP | 2003073757 | | 3/2003 |
| WO | WO 0168933 | A2 | 9/2001 |
| WO | WO 02/068708 | A1 | 9/2002 |

OTHER PUBLICATIONS

Davis et al., ASM Handbook, 1995, ASM International, vol. 4, 441.*
V.V. Meshcheryakova, Selection of the Optimal Composition of Steel for Manufacturing Furnace Tubes of Catalytic-Reforming Units, 1979, Khimicheskoe i Neftyanoe Mashinostroenie, No. 2, pp. 22-24.*
Davis et al., ASM Handbook, 1995, ASM International, vol. 4, 312-324.*
ASM Handbook vol. 1, Classification and Basic Metallurgy of Cast Iron, pp. 4-11.*
Davis et al., The ASM Handbook, Mar. 1990, vol. 1, pp. 847 and 944-947.*
Davis et al., The ASM Handbook, Aug. 1991, vol. 4, pp. 259-261.*
Dean, J.A. (1999). Lange's Handbook of Chemistry (15th Edition). McGraw-Hill. Online version available at: http://www.knovel.com/knovel2/Toc.jsp?BookID=47&VerticalID=0.*
Patnaik, Pradyot (2003). Handbook of Inorganic Chemicals., "Ammonia", (pp. 20-23). McGraw-Hill. Online version available at: http://www.knovel.com/knovel2/Toc.jsp?BookID=688&VerticalID=0.*

* cited by examiner

*Primary Examiner*—Roy King
*Assistant Examiner*—Jessee Roe
(74) *Attorney, Agent, or Firm*—Robert A. Migliorini

(57) ABSTRACT

Cermets, particularly composition gradient cermets can be prepared starting with suitable bulk metal alloys by a reactive heat treatment process involving a reactive environment selected from the group consisting of reactive carbon, reactive nitrogen, reactive boron, reactive oxygen and mixtures thereof.

17 Claims, 7 Drawing Sheets

COMPOSITION GRADIENT CERMETS AND REACTIVE HEAT TREATMENT PROCESS FOR PREPARING SAME

This application claims the benefit of U.S. Provisional application 60/471,992 filed May 20, 2003.

FIELD OF INVENTION

The present invention is broadly concerned with cermets, particularly composition gradient cermets and reactive heat treatment process for preparing same.

BACKGROUND OF INVENTION

Erosion resistant materials find use in many applications wherein surfaces are subject to eroding forces. For example, refinery process vessel internals exposed to aggressive fluids containing hard solid particles such as catalyst particles in various chemical and petroleum environments are subject to both erosion and corrosion. The protection of these vessel internals against erosion and corrosion induced material degradation especially at high temperatures is a technological challenge. Refractory liners are used currently for components requiring protection against the most severe erosion and corrosion such as the inside walls of cyclones such as the internal cyclones in fluid catalytic cracking units (FCCU). The life span of these refractory liners is significantly limited by mechanical attrition of the liner, cracking and spallation. The state-of-the-art in erosion resistant materials is chemically bonded castable alumina refractories. These castable alumina refractories are applied to the surfaces in need of protection and upon heat curing harden and adhere to the surface via metal-anchors or metal-reinforcements. It also readily bonds to other refractory surfaces. The typical chemical composition of one commercially available refractory is 80.0% $Al_2O_3$, 7.2% $SiO_2$, 1.0% $Fe_2O_3$, 4.8% MgO/CaO, 4.5% $P_2O_5$ in wt %.

Ceramic-metal composites are called cermets. Cermets of adequate chemical stability can provide an order of magnitude higher erosion resistance over refractory materials known in the art. Cermets are generally produced using powder metallurgy techniques where metal and ceramic powders are mixed, pressed and sintered at high temperatures. Since powder metallurgically produced cermets usually have homogeneous microstructure and uniform composition, sophisticated attachment methods are needed to attach cermets onto the metallic surfaces wherein erosion resistance of the surface is desired.

Composition gradient cermets are cermets wherein one surface of the cermet is ceramic-rich and the unexposed surface is metal-rich. In a typical composition gradient cermet there is a concentration gradient of the ceramic in the metal composition such that the concentration of the ceramic decreases with depth. These composition gradient cermets are desired and preferred for cost-effective attachment of cermets directly onto metal or alloy surfaces using methods such as welding due to the compatibility and ease of welding a substantially metallic object to another substantially metallic object. Furthermore, such composition gradient cermets can also exhibit superior durability particularly under conditions wherein thermal fluctuations are present. However, there is a need for effective processes to prepare composition gradient cermets.

One object of the present invention is to provide a process for preparation of cermets, particularly composition gradient cermets via reactive heat treatment of a metal alloy.

Another object of the present invention is to provide a composition gradient cermet product derived from the reactive heat treatment process.

These and other objects will become apparent from the description that follows.

SUMMARY OF INVENTION

In one embodiment is a process for preparing a composition gradient cermet material comprising the steps of:

heating a metal alloy containing at least one of chromium and titanium at a temperature in the range of about 600° C. to about 1150° C. to form a heated metal alloy;

exposing said heated metal alloy to a reactive environment comprising at least one member selected from the group consisting of reactive carbon, reactive nitrogen, reactive boron, reactive oxygen and mixtures thereof in the range of about 600° C. to about 1150° C. for a time sufficient to provide a reacted alloy; and cooling said reacted alloy to a temperature below about 40° C. to provide a composition gradient cermet material.

Another embodiment is directed towards a composition gradient cermet product obtained from the disclosed reactive heat treatment process.

DETAILED DESCRIPTION OF THE INVENTION

The first step of the process for preparing a composition gradient cermet material comprises heating a metal alloy containing at least one of chromium and titanium at a temperature in the range of about 600° C. to about 1150° C. to form a heated metal alloy. The metal alloy containing at least one of chromium and titanium comprises from about 12 to 60 wt % chromium, from 0 to 10 wt % titanium, and from 30 to 88 wt % of metals selected from the group consisting of iron, nickel, cobalt, silicon, aluminum, manganese, zirconium, hafnium, vanadium, niobium, tantalum, molybdenum, tungsten, and mixtures thereof. In a preferred embodiment the major mass constituent of the alloy is iron. Thus, stainless steels such as type 304SS, 347SS, 321SS, 310SS and the like and iron-nickel based alloys such as Incoloy 800H are particularly suitable for the instant process.

The second step of the process comprises exposing the heated metal alloy to a reactive environment selected from the group consisting essentially of reactive carbon, reactive nitrogen, reactive boron, reactive oxygen and mixtures thereof in the range of about 600° C. to about 1150° C. for a time period sufficient to provide a reacted alloy.

When the reactive environment is a reactive carbon environment carburization reactions are believed to occur. While not wishing to be bound to the mechanism of the reactive heat treatment process applicants believe that the carburization process leads to precipitation of chromium-rich and titanium carbide phases for example $Cr_7C_3$, $Cr_{23}C_6$ $(Cr_{0.6}Fe_{0.4})_7C_3$, $(Cr_{0.6}Fe_{0.4})_{23}C_6$ and TiC on the alloy surface and within the alloy matrix resulting in a cermet and particularly a composition gradient carbide cermet.

A reactive carbon environment is defined as an environment in which the thermodynamic activity of carbon ($a_c$) in the environment is greater than that of the alloy.

$$(a_c)_{environment} > (a_c)_{metal}$$

The reactive carbon environment suitable for the instant invention comprises at least one of CO, $CH_4$, $C_2H_6$ or $C_3H_8$. The reactive carbon environment may optionally include $H_2$. The reactive carbon environment may further comprise $O_2$, $CO_2$, and $H_2O$. The following reactions [1], [2] and [3] shown below are some of the reactions that are believed to occur under the heat treatment conditions to provide the reactive carbon. The carbon reacts with the metal surface to form chromium-rich and titanium-rich carbide phases.

$$CO + H_2 \rightarrow C + H_2O \quad [1]$$

$$2CO \rightarrow C + CO_2 \quad [2]$$

$$CH_4 \rightarrow C + 2H_2 \quad [3]$$

Figure 1:
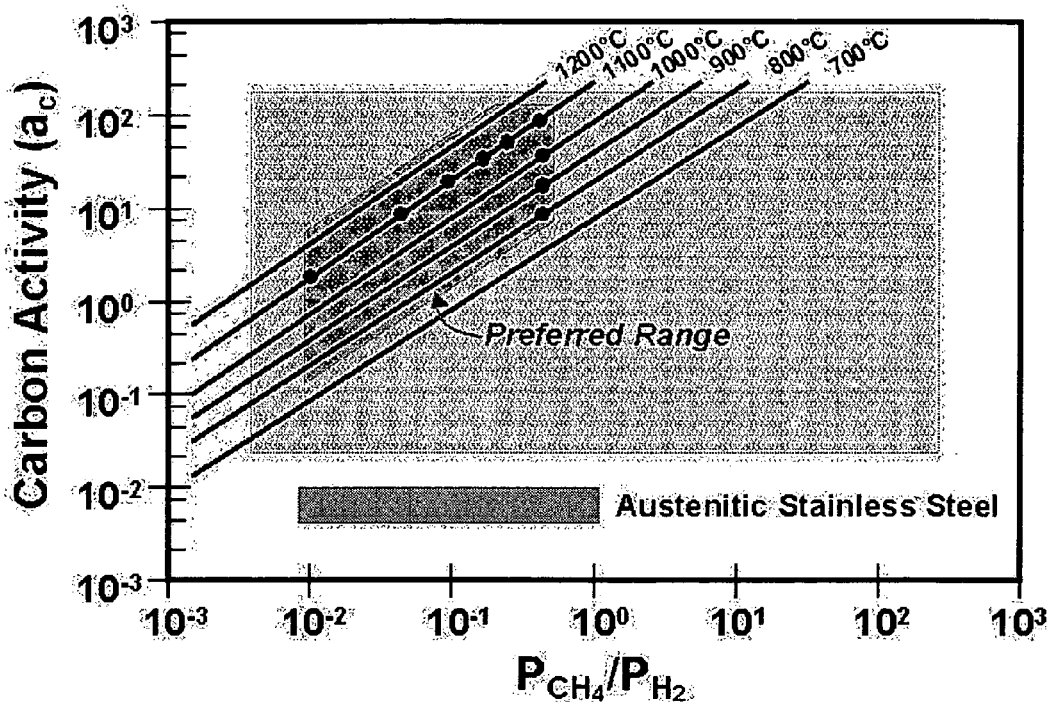
FIG. 1 depicts carbon activity of an environment based on the reaction $CH_4 \rightarrow C+2H_2$ compared to austenitic stainless steels ($a_c$ in equilibrium with $Fe_3C$). Also marked are the carbon activity values of gas mixtures applicable to the instant invention.

When heat treatment follows reaction [3], the carbon activity ($a_c$) in the environment is $$a_c = e^{-G^\circ/RT}(P_{CH4}/P^2_{H2})$$

where G° is the free energy of activation, R is the gas constant, T is the temperature in Kelvin units and P is the partial pressure of the respective gases methane and hydrogen. Carbon activities as a function of $(P_{CH4}/P^2_{H2})$ are plotted in FIG. 1 wherein is indicated the preferred range of $P_{CH4}/P^2_{H2}$ for the process of the instant invention.

Figure 2:
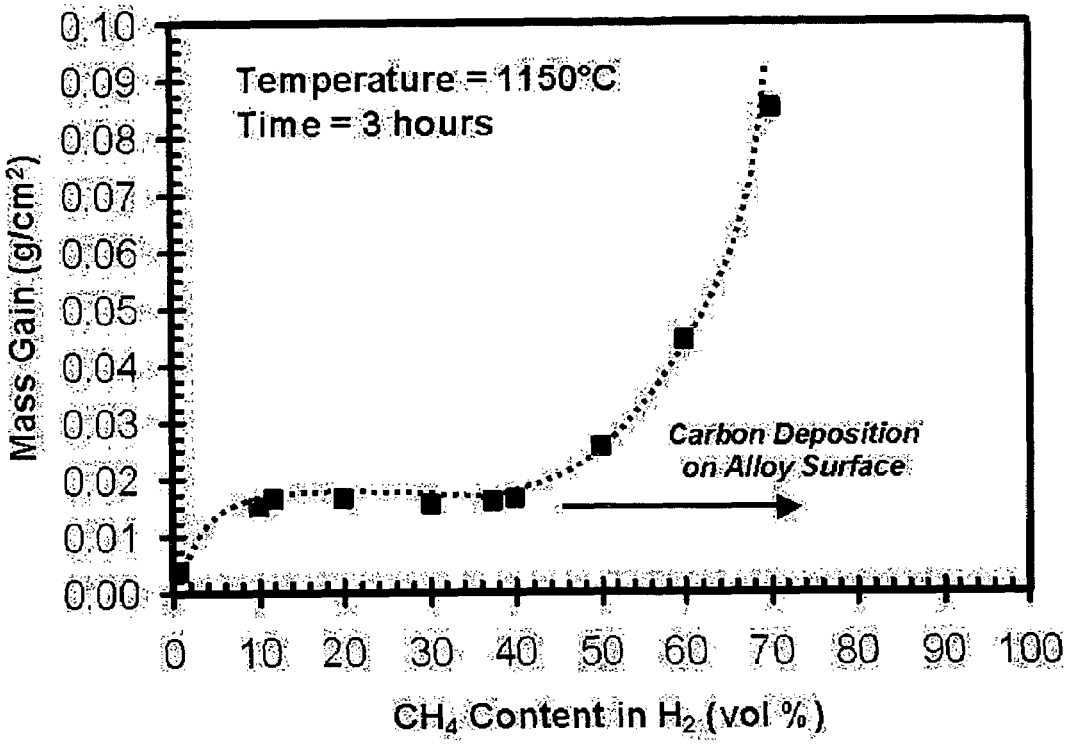
FIG. 2 depicts the mass gain due to carbon ingression (a measure of cermet layer formation) of 304 stainless steel (74Fe:18Cr:8Ni in wt %) as a function of $CH_4$ content in $H_2$ at 1100° C. for 3 hours.
Figure 3:
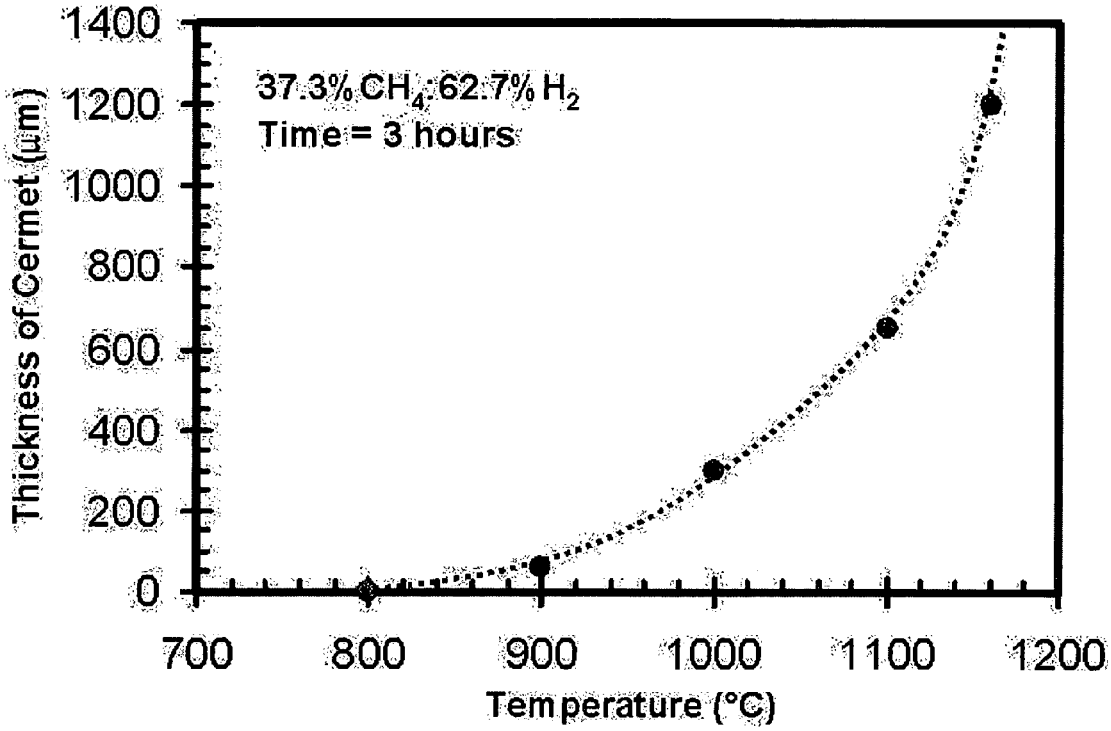
FIG. 3 depicts the thickness variation of surface cermet structure on 304 stainless steel as a function of temperature in 37.3 vol % $CH_4$:62.7 vol % $H_2$ environment for 3 hours.

When a mixture of methane and hydrogen are used to provide the reactive carbon environment, the methane content in the gaseous mixture of methane and hydrogen can range from about 1 vol % to about 99 vol %, preferably about 2 vol % to about 45 vol %. This is depicted in FIG. 2, where the mass gain due to carbon ingression (a measure of cermet layer formation) of 304 stainless steel (74Fe:18Cr:8Ni in wt %) at 1100° C. exposed for 3 hours is plotted as a function of $CH_4$ content in $H_2$. The preferred methane content in the gaseous mixture of methane and hydrogen corresponds to the plateau region of the curve. In this range, the reaction times are shorter to obtain a specific thickness of cermet. Gas mixtures in which the methane content in the gaseous mixture of methane and hydrogen is greater than 45 vol % can also be used. However, in these ranges, solid carbon deposition on the alloy surface can be encountered as indicated by the rapid increase of mass gain in FIG. 2.

When a mixture of CO and hydrogen are used to provide the reactive carbon environment, the CO content in the gaseous mixture of CO and hydrogen can range from about 0.1 vol % to about 5 vol %, preferably about 0.1 vol % to about 2 vol %.

When the reactive environment is a reactive nitrogen environment, nitridation reactions are believed to occur. While not wishing to be bound to the mechanism of the reactive heat treatment process applicants believe that the nitridation process leads to precipitation of chromium-rich and titanium nitride phases for example $Cr_2N$ and TiN on the alloy surface and within the alloy matrix resulting in a cermet and particularly a composition gradient nitride cermet.

A reactive nitrogen environment is defined as an environment in which the thermodynamic activity of nitrogen ($a_N$) in the environment is greater than that of the alloy.

$$(a_N)_{environment} > (a_N)_{metal}$$

Since molecular nitrogen is relatively inert in terms of nitridation of an alloy, ammonia-bearing atmospheres are preferred. Ammonia is metastable and dissociates into molecular $N_2$ and molecular $H_2$ when heated to elevated temperatures. The preferred composition of the reactive nitrogen environment comprises at least one of air, ammonia and nitrogen. The composition can further comprise $H_2$, He, and Ar. In such a reactive nitrogen environment at temperatures in the range of 600° C. to 1150° C. alloys containing elements such as Cr and Ti which have strong chemical affinities for nitrogen undergo rapid nitridation reactions. In order to increase nitrogen absorption by the alloy, molecular $NH_3$ is preferred to dissociate on the alloy surface, thus allowing dissociated atomic nitrogen to dissolve at the surface and diffuse into the bulk interior of the metal alloy. Similar to carburization process, nitridation can lead to the formation of surface nitrides, internal nitrides in the matrix and at grain boundaries near the alloy surface.

When a mixture of ammonia and hydrogen are used to provide the reactive nitrogen environment, the ammonia content in the gaseous mixture of ammonia and hydrogen can range from about 1 vol % to about 99 vol %, preferably about 2 vol % to about 70 vol %.

The preferred temperature range for accomplishing the conversion of a metal alloy containing chromium, titanium and mixtures thereof to a nitride cermet is in the range of about 600° C. to about 1150° C.

When the reactive environment comprises a mixture of reactive carbon and reactive nitrogen a mixed composition gradient cermet comprising carbide, nitride, carbonitride and mixtures thereof results. When the reactive environment is a reactive carbon and nitrogen environment, carbonitridation reactions are believed to occur. While not wishing to be bound to the mechanism of the reactive heat treatment process applicants believe that the carbonitridation process leads to precipitation of chromium-rich and titanium carbonitride phases for example $Cr_2CN$ and TiCN on the alloy surface and within the alloy matrix resulting in a cermet and particularly a composition gradient carbonitride cermet.

A reactive carbon and nitrogen environment is defined as an environment in which the thermodynamic activity of carbon ($a_C$) and nitrogen ($a_N$) in the environment is greater than that of the alloy. The preferred composition of the reactive carbon and nitrogen environment comprises at least one of ammonia and nitrogen and at least one of CO, $CH_4$, $C_2H_6$ or $C_3H_8$. The composition can further comprise $H_2$, He, and Ar. In such a reactive carbon and nitrogen environment at temperatures in the range of 600° C. to 1150° C. alloys containing elements such as Cr and Ti which have strong chemical affinities for carbon and nitrogen undergo rapid carbonitridation reactions. Similar to carburization or nitridation process, carbonitridation can lead to the formation of surface carbonitride, internal carbonitride in the matrix and at grain boundaries near the alloy surface.

When the reactive environment is a reactive boron environment, boridation reactions are believed to occur. While not wishing to be bound to the mechanism of the reactive heat treatment process applicants believe that the boridation process leads to precipitation of chromium-rich and titanium boride phases for example $Cr_2B$ and $TiB_2$ on the alloy surface and into the alloy matrix resulting in a cermet and particularly a composition gradient boride cermet.

A reactive boron environment is defined as an environment in which the thermodynamic activity of boron ($a_B$) in the environment is greater than that of the alloy. The preferred composition of the reactive boron environment comprises for example at least one of diborane ($B_2H_6$), $BCl_3$, and $BF_3$. The composition can further comprise $H_2$, He, and Ar. In such a reactive boron environment at temperatures in the range of 600° C. to 1150° C. alloys containing elements such as Cr and Ti which have strong chemical affinities for boron undergo rapid boridation reactions. Similar to carburization or nitridation process, boridation can lead to the formation of surface borides, internal borides in the matrix and at grain boundaries near the alloy surface.

When the reactive environment is a reactive oxygen environment, oxidation reactions are believed to occur. While not wishing to be bound to the mechanism of the reactive heat treatment process applicants believe that the oxidation process leads to precipitation of chromium-rich and titanium oxide phases for example $(Cr,Fe)_2O_3$, $Cr_2O_3$ and $TiO_2$ on the alloy surface and within the alloy matrix resulting in a cermet and particularly a composition gradient oxide cermet.

A reactive oxygen environment is defined as an environment in which the oxygen potential in the environment is greater than the oxygen partial pressure in equilibrium with the oxide. The preferred composition of the reactive oxygen environment comprises at least one of air, oxygen and $CO_2$. The composition can further comprise $H_2$, He, and Ar. In such a reactive oxygen environment at temperatures in the range of 600° C. to 1150° C. alloys containing elements such as Cr and Ti which have strong chemical affinities for oxygen undergo rapid oxidation reactions. Similar to carburization or nitridation process, oxidation can lead to the formation of surface oxides, internal oxides in the matrix and at grain boundaries near the alloy surface.

The third step of the process is cooling of the reacted alloy. The cooling step can include a variety of cooling rates and/or an intermediate temperature hold before cooling to below about 40° C. In one embodiment the cooling step comprises cooling the reacted alloy at a rate in the range of 0.5° C. per second to 25° C. per second. In another embodiment the cooling step comprises cooling said reacted alloy to a temperature in the range of 500° C. to 100° C., holding the temperature at any temperature in the range of 500° C. to 100° C. for a time period between 5 minutes to 10 hours and thereafter cooling at a rate in the range of 0.5° C. per second to 25° C. per second to below about 40° C. Applicants believe this preferred cooling profile has process and product advantages.

Figure 4:
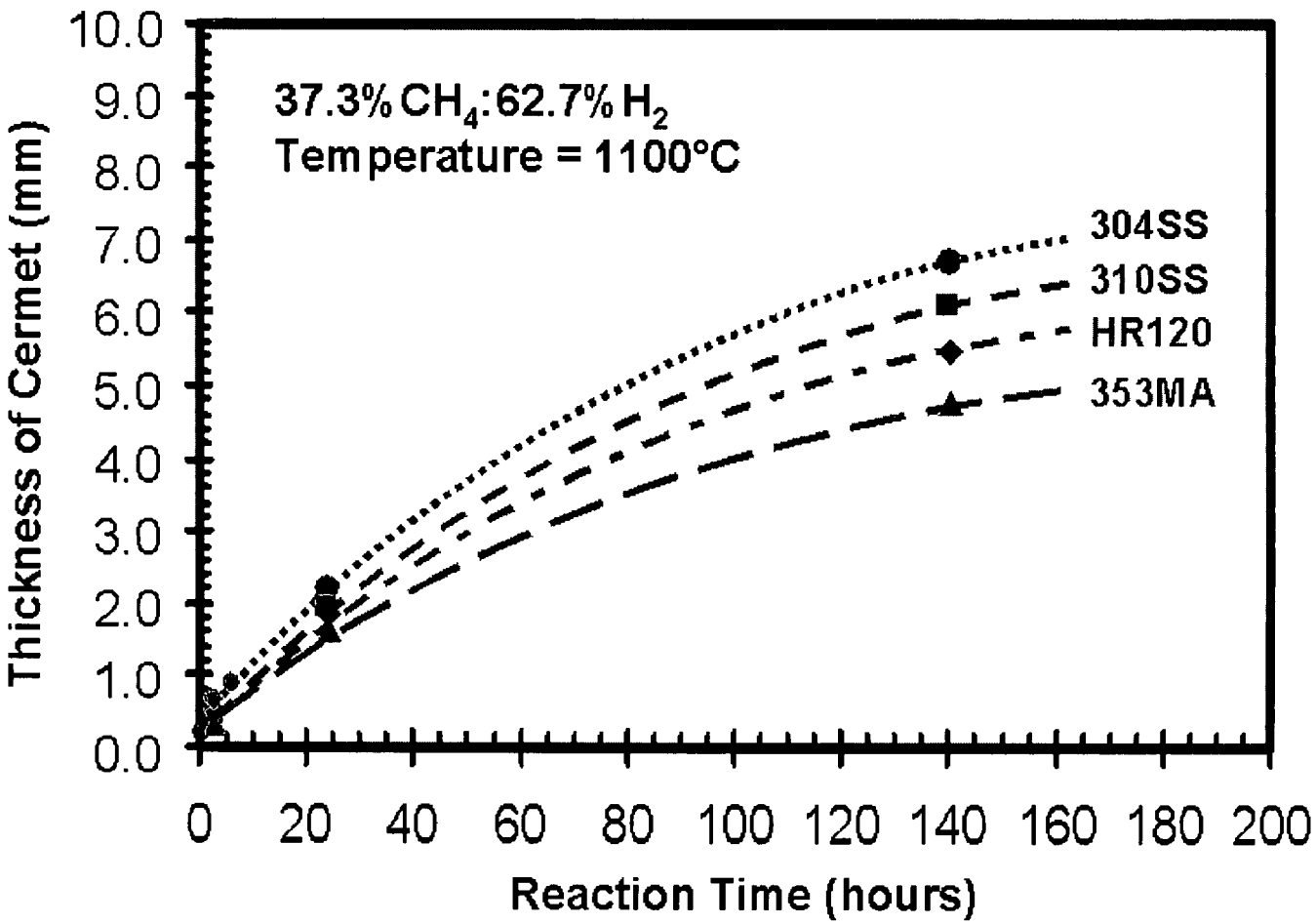
FIG. 4 depicts the thickness variation of surface cermet formed on various Fe:Ni:Cr based high temperature alloys as a function of reaction times at 1100° C. in 37.3 vol % $CH_4$: 62.7 vol % $H_2$ environments.

The exposure time (the time period the heated alloy is exposed to the reactive environment) can vary in the range of about 1 hour to 800 hours to achieve various thickness of the carbide, nitride, carbonitride, boride or oxide cermet on the surface the metal alloy. An example for carbide cermet is depicted in FIG. 4 where the thickness of the surface carbide cermet formed on various Fe:Ni:Cr high temperature alloys is plotted as a function of exposure time at conditions of 1100° C. in 37.3 vol % $CH_4$:62.7 vol % $H_2$ environment. Thus, this example shows that the process of the instant invention can be used to obtain any thickness of carbide cermet resulting in a composition gradient carbide cermet. Alternately, the process can also be used to completely convert the entire bulk of the chromium, titanium or mixture of chromium and titanium comprising alloy to a composition gradient cermet wherein the gradient traverses the entire thickness of the bulk alloy.

The thickness of cermet layers can be controlled by the composition of the reactive environment, the temperature and the exposure time. Exposure times can be determined experimentally as depicted in FIG. 4 for a carbide cermet. For thinner layers, the exposure time will be less, and for thicker layers the exposure time will be greater. Typical exposure times for a carbide cermet can range from about 1 hour to about 500 hours, preferably from about 5 hours to about 300 hours, and more preferably from about 10 hours to about 200 hours. Thus, the exposure time and temperature are two variables that can provide a desired thickness of cermet and a desired composition gradient cermet. For a nitride cermet, typical exposure times can range from about 1 hour to about 800 hours, preferably from about 5 hours to about 500 hours, and more preferably from about 10 hours to about 300 hours. Thus, the exposure time and temperature are two variables that can provide a desired thickness of nitride cermet and a desired composition gradient nitride cermet.

Typical layer or cermet structure thickness can range from at least about 100 microns up to the thickness of the metal alloy being acted on, preferably from about 5 mm to about 30 mm, more preferably from about 5 mm to about 20 mm. Layer thickness can be determined by electron microscopy techniques known to one of ordinary skill in the art of electron microscopy.

The instant invention is also applicable to an article consisting of an amount of chromium-rich or titanium-rich carbide, nitride, carbonitride, boride, and oxide in combination with a chromium and titanium containing metal alloy.

The reactive heat treatment process of the instant invention results in a composition gradient cermet having erosion resistance superior to that of the untreated alloy containing chromium, titanium and mixtures thereof as shown in Example 4. This is because the erosion resistance of the alloy improves as the cermet layer develops and provides hardening. In the instant invention, the amount of reactive carbon, reactive nitrogen, reactive boron, reactive oxygen diffusing into the metal alloy containing chromium, titanium and mixtures thereof from the respective reactive environment is utilized to produce the composition gradient cermet. The portion of the alloy containing chromium, titanium and mixtures thereof not converted to cermet, is unchanged and maintains the physical properties it possessed prior to treatment in accordance with the instant invention. This composition gradient structure is particularly advantageous when one desires to use welding as an attachment method of the carbide cermet to a surface. Furthermore, a composition gradient cermet can have a superior thermal expansion match with the underlying metallic substrate with superior durability under thermal fluctuations. Thus, the cermet layer provides erosion resistance while retaining physical properties for the attachment and mechanical reliability of the alloy.

The composition gradient cermets produced by the process of instant invention can be used in the temperature range of 300° C. to 800° C. to protect any steel or any other alloy surface exposed to severe erosion and abrasion. Some non-limiting examples of these applications include protective linings, lining tiles for fluid-solids separation cyclones as in the cyclone of Fluid Catalytic Cracking Unit used in refining industry, wear plates, nozzle and grid hole inserts, turbine blades and components subject to erosion flow streams. In these applications composition gradient cermets prepared by the process of the instant invention offer a combination of erosion resistance and toughness as well as an optimization of thermal stresses within the component. Compared to conventional cermets prepared via powder metallurgy method, it affords attachment via conventional welding techniques and a better matching of thermal expansion to the base steel. It also could provide a superior method of protecting turbine blades from both oxidation and erosion.

Another embodiment of the invention is directed to a composition gradient cermet product prepared by the process comprising:

heating a metal alloy containing at least one of chromium and titanium at a temperature in the range of about 600° C. to about 1150° C. to form a heated metal alloy;

exposing said heated metal alloy to a reactive environment comprising at least one member selected from the group consisting of reactive carbon, reactive nitrogen, reactive boron, reactive oxygen and mixtures thereof in the range of about 600° C. to about 1150° C. for a time sufficient to provide a reacted alloy; and cooling said reacted alloy to a temperature below about 40° C.

The process of the instant invention can be applied to any surface. For example the internal surface of any chemical or petroleum processing reactor comprised of a metal selected from the group consisting essentially of chromium, titanium and mixtures thereof at a temperature can be heated to a temperature in the range of about 600° C. to about 1150° C. and then exposed to a reactive environment selected from the group consisting essentially of reactive carbon, reactive nitrogen, reactive boron, reactive oxygen and mixtures thereof in the range of about 600° C. to about 1150° C. for a time period sufficient to provide a reacted internal surface. Upon cooling to temperatures below about 40° C. a composition gradient cermet material is formed on the internal surface of the reactor. The internal surface of the reactor comprising the composition gradient cermet can exhibit enhanced erosion resistance. One non-limiting illustrative example of this use is the cyclone separator of a Fluid Catalyst Cracking Unit in oil refining.

As another example, the surface of any object, for example the blades of a turbine, can be made of a metal selected from the group consisting of essentially of chromium, titanium and mixtures thereof at a temperature, heated to a temperature in the range of about 600° C. to about 1150° C. and then exposed to a reactive environment selected from the group consisting essentially of reactive carbon, reactive nitrogen, reactive boron, reactive oxygen and mixtures thereof in the range of about 600° C. to about 1150° C. for a time period sufficient to provide a heat treated object. Upon cooling to temperatures below about 40° C. a composition gradient cermet material is formed on the surface of the object exposed to the reactive environment.

The cermet compositions prepared by the process of the instant invention possess enhanced erosion and corrosion properties. The erosion rates were determined by the Hot Erosion and Attrition Test (HEAT) as described in the examples section of the disclosure. The erosion rate of the gradient cermets prepared by the process of the instant invention is less than $1.0\times10^{-6}$ cc/gram of SiC erodant. The corrosion rates were determined by thermogravimetric (TGA) analyses as described in the examples section of the disclosure. The corrosion rate of the gradient cermets prepared by the process of the instant invention is less than $1\times10^{-10}$ $g^2/cm^4sec$.

The cermet compositions prepared by the process of the instant invention possess fracture toughness of greater than about 3 $Mpa.m^{1/2}$, preferably greater than about 5 $MPa.m^{1/2}$, and more preferably greater than about 10 $MPa.m^{1/2}$. Fracture toughness is the ability to resist crack propagation in a material under monotonic loading conditions. Fracture toughness is defined as the critical stress intensity factor at which a crack propagates in an unstable manner in the material. Loading in three-point bend geometry with the pre-crack in the tension side of the bend sample is preferably used to measure the fracture toughness with fracture mechanics theory. The cermets of the instant invention can be affixed to metal surfaces by mechanical means or by welding.

EXAMPLES

The following non-limiting examples are included to further illustrate the invention.

Example 1

Reactive Heat Treatment of Commercial Alloys

The reactive heat treatments were conducted on the selected chromium containing commercial alloys, 304SS, 310SS, Haynes HR120 and Inconel 353MA. The nominal compositions are given below.

TABLE 1

Compositions of Chromium Containing Commercial Alloys

| Alloys | UNS No. | Composition (wt %) |
|---|---|---|
| 304 Stainless Steel | S30400 | Bal Fe:18.5Cr:9.6Ni:1.4Mn:0.6Si |
| 310 Stainless Steel | S31000 | Bal Fe:25.0Cr:21.0Ni:1.5Si:2.0Mn |
| Haynes HR120 | N08120 | Bal Fe:33.0Cr:37.0Ni:2.5Mo:2.5W:0.6Si |
| Inconel 353MA | S35315 | Bal Fe:24.8Cr:34.8Ni:1.6Si:1.4Mn |

The samples had rectangular geometry with dimensions of about 1.25 cm×1.25 cm×1 cm. The sample surfaces were ground to a 600 grit SiC finish and cleaned ultrasonically in acetone. The procedure used in the invention was to establish the kinetics of carburization of the selected alloys in a purely carburizing environment ($CH_4$—$H_2$), which was determined thermogravimetrically in a Cahn 1000 thermogravimetric unit. The investigations were carried out in the temperature range, 800° C. to about 1160° C. A coupon was heated to a temperature of 1100° C. in a hydrogen environment in a vertical quartz reactor tube and held at that temperature for approximately 5 minutes. Thereupon, the environment was changed to 37.3 vol % $CH_4$-62.7 vol % $H_2$. After 3 hours of exposure, lowering the furnace surrounding the quartz reactor cools the metal sample. After the sample has attained room temperature, the surface microstructure was examined by scanning electron microscopy. By "Bal" is meant balance of metal in the constituent composition.

Figure 5:
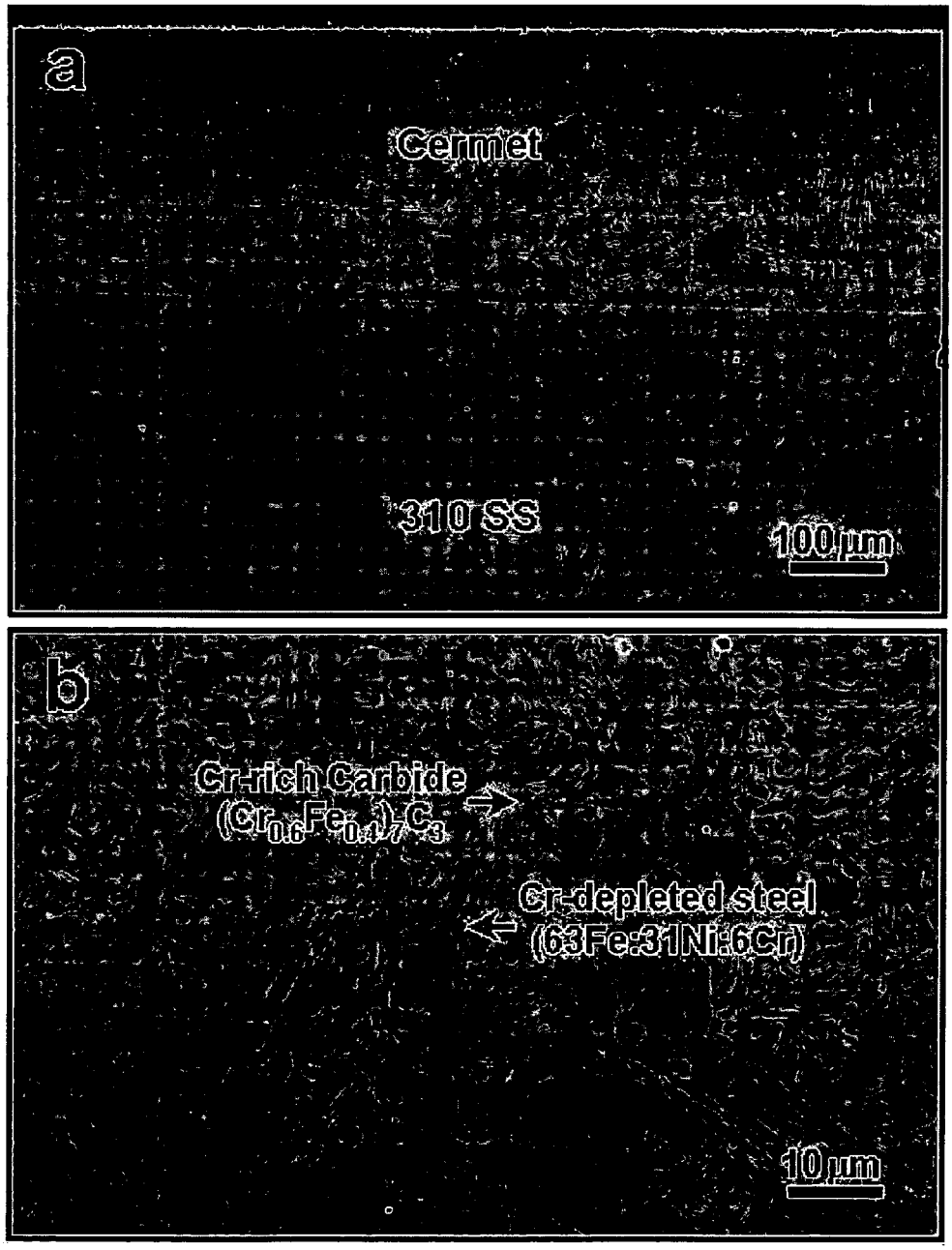
FIG. 5 depicts scanning electron micrographs showing (a) surface chromium carbide-metal cermet structure on 310 stainless steel (54Fe:21Ni:25Cr in wt %) after reactive heat treatment at 1100° C. for 3 hours in 37.3 vol % $CH_4$:62.7 vol % $H_2$ environment and (b) enlarged area on the surface revealing the Cr-rich carbide $[(Cr_{0.6}Fe_{0.4})_7C_3]$ and Cr-depleted steel (63Fe:31Ni:6Cr in wt %) to produce a composite ceramic-metal two-phase structure. In this scanning electron micrograph the Cr-rich carbides appear dark gray and the metal appears recessed, because it has etched more deeply than the carbides. These figures show the final product having the cermet surface, which is the product of the process of the instant invention.

FIG. 5*a* reveals that a chromium carbide-metal cermet layer of 400 micron thickness has formed on 310 stainless steel (54Fe:21Ni:25Cr in wt %) surface after reactive heat treatment at 1100° C. for 3 hours in 37.3 vol % $CH_4$:62.7 vol % $H_2$ environment. A magnified view of cermet microstructure, revealing the Cr-rich carbide $[(Cr_{0.6}Fe_{0.4})_7C_3]$ and Cr-depleted steel (63Fe:31Ni:6Cr in wt %) to produce a composite ceramic-metal two-phase structure, is depicted in FIG. 5*b*. Cr-rich is meant that the metal Cr is of a higher proportion on a weight basis than the other constituent metals comprising M, where M is 54Fe:21Ni:25Cr in wt %. In this scanning electron micrograph the Cr-rich carbides appear dark gray and the metal appears recessed, because it has etched more deeply than the carbides. These figures show the final product having the cermet surface, which is produced in accordance with this invention. Changing the duration of exposure to the carbon gaseous environment changes the thickness of the cementite layer. This is shown by the graph in FIG. 4.

Example 2

Reactive Heat Treatment of Commercial Alloys

The chromium containing alloys listed above were reactively heat treated in a tube furnace for 24 hours at 1100° C. in 10 vol % $CH_4$:90 vol % $H_2$ environment. Samples were heated to a temperature of 1100° C. in a hydrogen environment and held at that temperature for approximately 5 minutes. After 24 hours of exposure, the alloy samples were cooled down. After the samples reached room temperature (25° C.), the surface microstructure and the thickness of cermet layer formed on various alloy surfaces were investigated by cross sectional scanning electron microscopy. Chemical compositions of $M_7C_3$ carbide phase and Cr-depleted binder phase were investigated by semi-quantitative energy dispersive x-ray spectroscopy. The tendencies of Fe and Ni to partition between the metal matrix and the carbide precipitates are expected to be different. The thickness of cermet layers, Cr and Fe contents in $M_7C_3$ carbide phase and composition of Cr-depleted metal matrix phase without cermet layers are summarized below.

TABLE 2

The Thickness, Cr and Fe Contents in $M_7C_3$ Carbide Phase and Composition of Cr-depleted Metal Matrix Phase within Cermet Layers after Reactive Heat Treatment of Selected Chromium Containing Commercial Alloys

| Alloys | Thickness of cermet layer (mm) | Cr and Fe Contents in $M_7C_3$ Carbide Phase (wt %) | Composition of Cr-depleted metal matrix phase (wt %) |
|---|---|---|---|
| 304 Stainless Steel | 2.13 | 27.0Cr:73.0Fe | 76.6Fe:3.6Cr:19.8Ni |
| 310 Stainless Steel | 1.90 | 52.0Cr:48.0Fe | 63.0Fe:5.8Cr:30.2Ni |
| Haynes HR120 | 1.79 | 58.0Cr:42.0Fe | 36.7Fe:4.4Cr:58.9Ni |
| Inconel 353MA | 1.50 | 58.0Cr:42.0Fe | 37.4Fe:4.1Cr:58.5Ni |

Example 3

Reactive Heat Treatment of Custom-Made Alloys

Alloys containing different concentrations of Fe, Ni, Cr and Ti were prepared by arc melting. The arc-melted alloy buttons were annealed at 1100° C. overnight in inert argon atmosphere and furnace-cooled to room temperature. Cubical samples of about 1.25 cm×1.25 cm×0.75 cm were cut from the buttons. The sample faces were polished to 600-grit finish and cleaned in acetone. The specimens were exposed to a 10 vol % $CH_4$:90 vol % $H_2$ gaseous environment at 1100° C. for 24 hours.

Figure 6:
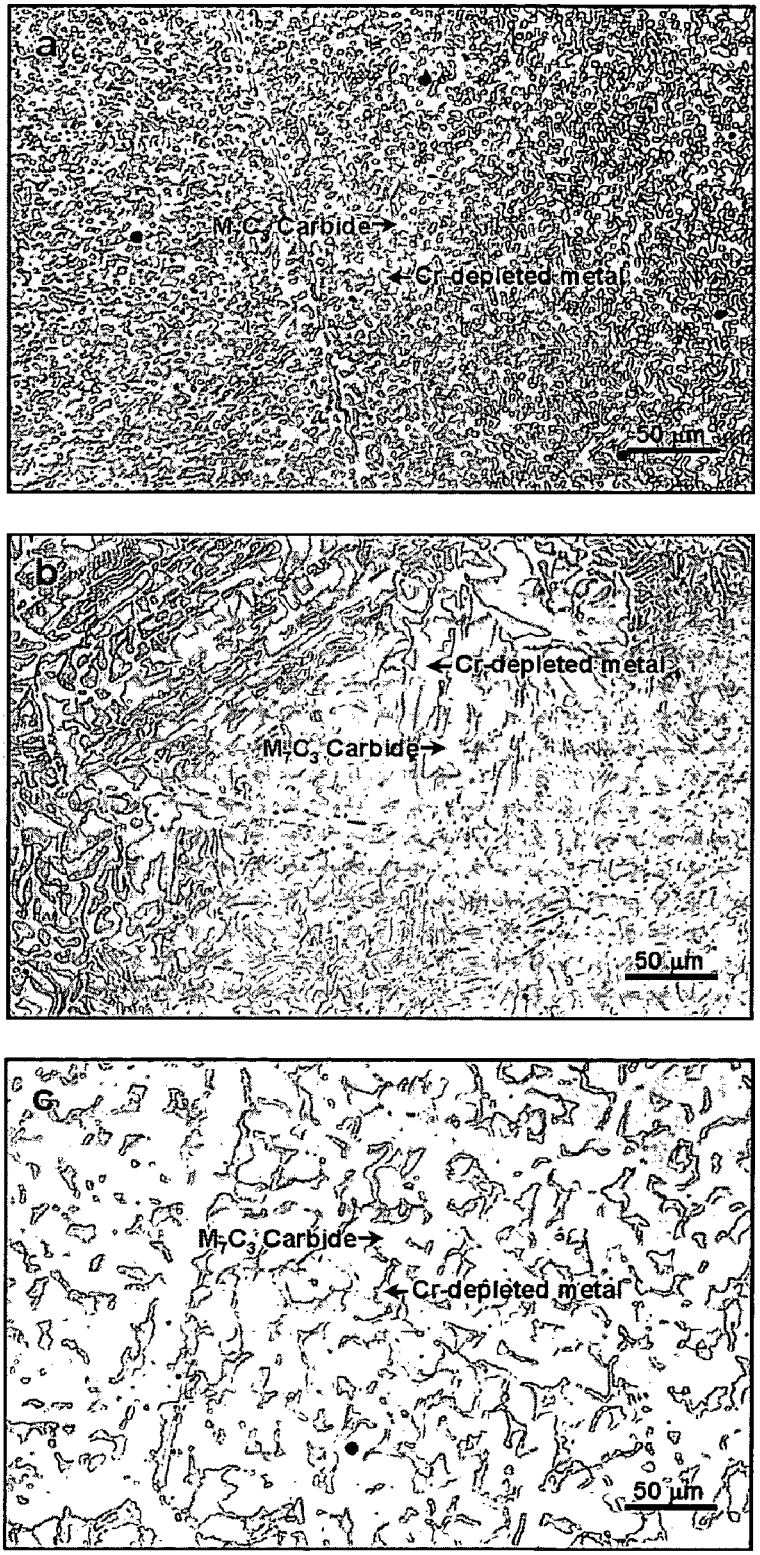
FIG. 6 depicts optical micrographs showing $M_7C_3$ (M=Cr and Fe) carbide-metal cermet structure on (a) 55Fe:35Cr: 10Ni (in wt %) alloy, (b) 45Fe:45Cr:10Ni (in wt %) alloy and (c) 35Fe:55Cr:10Ni (in wt %) alloy after reactive heat treatment at 1100° C. for 24 hours in 10 vol % $CH_4$:90 vol % $H_2$ environment.

Detailed electron microscopy and chemical analysis of the alloys after exposure indicated that specific alloy compositions in the Fe-Ni-Cr system generate cermet structure with $M_7C_3$ carbide and metal phase. The thickness of cermet layers, Cr and Fe contents in $M_7C_3$ carbide phase and compositions of Cr-depleted metal matrix phase within cermet layers are summarized in Table 3. By contrast to the example of selected commercial alloys, relatively thick cermet layer was obtained and the concentration of Cr in metal matrix phase formed in the Fe-Ni-Cr system was relatively enriched. Higher Cr concentration in metal phase enhances oxidation resistance at higher temperatures. The optical microscopic image shown in FIG. 6 indicates the size and morphology of $M_7C_3$ (M=Cr and Fe) carbide-metal cermet structure in the surface regions after reactive heat treatment at 1100° C. for 24 hours in 10 vol % $CH_4$:90 vol % $H_2$.

Figure 7:
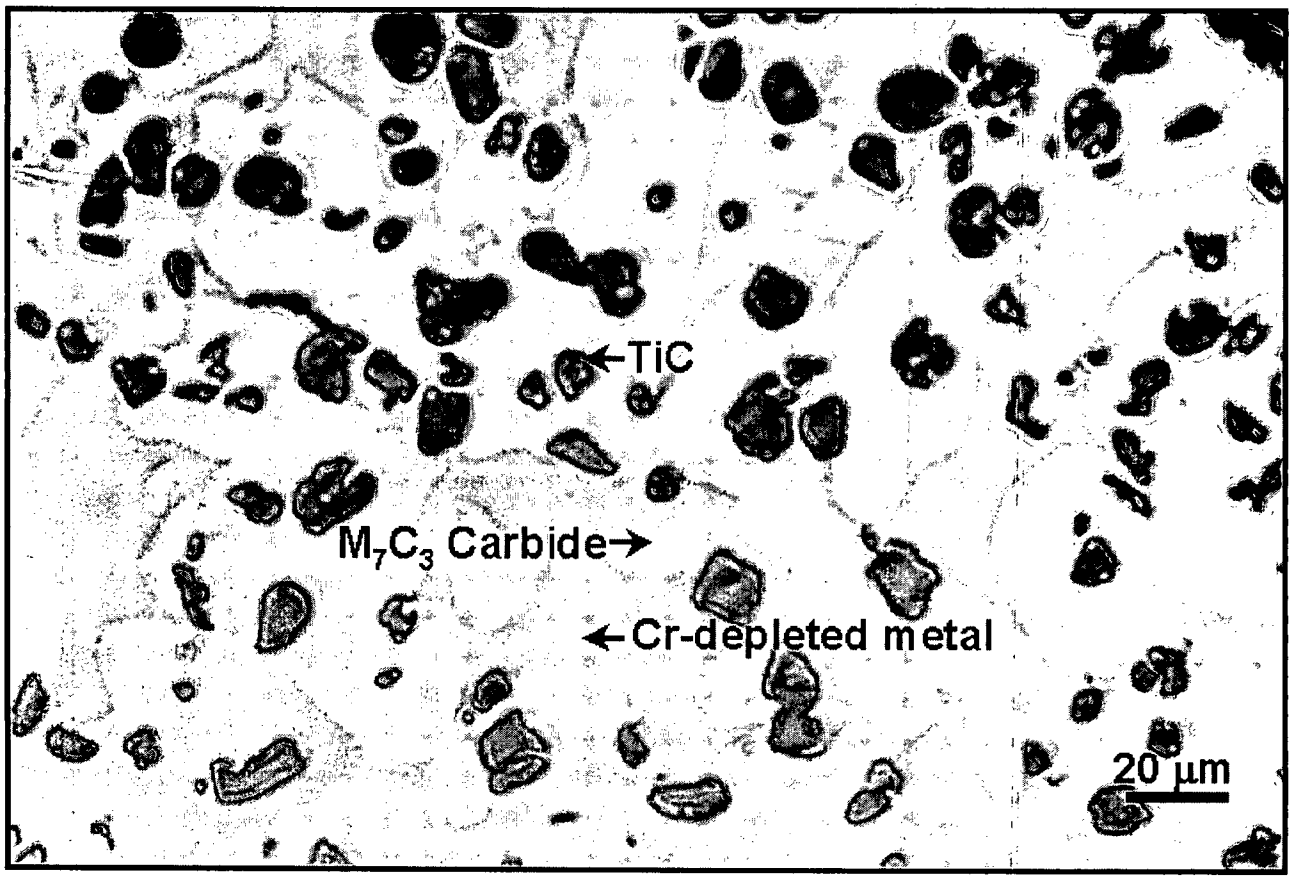
FIG. 7 depicts optical micrographs showing mixed TiC and $M_7C_3$ (M=Cr and Fe) carbide-metal cermet structure on 60Fe:25Cr:10Ni:5Ti (in wt %) alloy after reactive heat treatment at 1100° C. for 24 hours in 10 vol % $CH_4$:90 vol % $H_2$ environment.

An alloy of composition 60Fe:25Cr:10Ni:5Ti (in wt %) generates cermet structure with mixed TiC and $M_7C_3$ carbide and metal phase. The thickness of cermet layers, Cr and Fe contents in $M_7C_3$ carbide phase and compositions of Cr-depleted metal matrix phase within cermet layers are summarized in Table 3. The optical microscopic image shown in FIG. 7 indicates the size and morphology of mixed TiC and $M_7C_3$ (M=Cr and Fe) carbide-metal cermet structure in the surface regions after reactive heat treatment at 1100° C. for 24 hours in 10 vol % $CH_4$:90 vol % $H_2$.

TABLE 3

The Thickness, Cr and Fe Contents in $M_7C_3$ Carbide Phase and Composition of Cr-depleted Metal Matrix Phase within Cermet Layers after Reactive Heat Treatment of Fe—Ni—Cr—Ti system

| Alloys (wt %) | Thickness of cermet layer (mm) | Cr and Fe Contents in $M_7C_3$ Carbide Phase (wt %) | Composition of Cr-depleted metal matrix phase (wt %) |
|---|---|---|---|
| 55Fe:35Cr:10Ni | 3.17 | 48.0Cr:52.0Fe | 65.3Fe:7.9Cr:26.8Ni |
| 45Fe:45Cr:10Ni | 3.35 | 77.1Cr:22.9Fe | 67.6Fe:13.8Cr:18.6Ni |
| 35Fe:55Cr:10Ni | 1.00 | 79.0Cr:21.0Fe | 52.1Fe:7.0Cr:40.9Ni |
| 60Fe:25Cr:10Ni:5Ti | 2.50 | 66.3Cr:33.7Fe | 74.5Fe:9.1Cr:16.4Ni |

Example 4

Erosion Testing

The reactive heat treatments were conducted on commercial 310SS to prepare samples for Hot Erosion and Attrition Test (HEAT). The 310SS samples had rectangular geometry with dimensions of about 2.0 inch×2.0 inch×0.5 inch. One sample was reactively heat treated in a tube furnace for 138 hours at 1100° C. in 10 vol % $CH_4$:90 vol % $H_2$ environment and named as C310SS1100. The other sample was reactively heat treated in a tube furnace for 96 hours at 1150° C. in 10 vol % $CH_4$:90 vol % $H_2$ environment and named as C310SS1150.

Erosion Rate was measured as the volume of cermet, refractory, or comparative material removed per unit mass of erodant particles of a defined average size and shape entrained in a gas stream, and had units of cc/gram (e.g., <0.001 cc/1000 gram of SiC). Key defined erosion test conditions are erodant material and size distribution, velocity, mass flux, angle of impact of the erodant as well as erosion test temperature and chemical environment.

Erosion Loss of Cermet was measured by the Hot Erosion and Attrition Test (HEAT). The carrier gas and atmosphere, simulating the intended use, but preferably air, were heated to the same temperature. HEAT tests were preferably operated as follows. In the preferred operation of the HEAT test, the cermet specimen blocks (C310SS1100 and C310SS1150) of about 2 inch square and about 0.5 inch thickness were weighed to an accuracy of ±0.01 mg. The center of one side of the bock was subjected to 1200 g/min of SiC particles entrained in an air jet exiting from a riser tube with a 0.5 inch diameter where the end of the riser tube was 1 inch from the target disk. The 58 μm angular SiC particles used as the erodant were 220 grit #1 Grade Black Silicon Carbide (UK Abrasives, Inc., Northbrook, Ill.). The erodant velocity impinging on cermet targets was 45.7 m/sec (150 ft/sec) and the impingement angle of the gas-erodant stream on the target was 45°±5°, preferably 45°±2° between the main axis of the riser tube and the surface of the specimen disk. The carrier gas was air for all tests. The erosion tests in the HEAT unit were performed at 732° C. (1350° F.) for 7 hours. After testing the cermet specimen were again weighed to an accuracy of ±0.01 mg, to determine the weight loss. The erosion rate was equal to the volume of material removed per unit mass of erodant particles entrained in the gas stream, and has units of cc/gram. Improvement in Table 4 is the reduction of weight loss due to erosion compared to a value of 1.0 for the standard RESCO-BOND™ AA-22S (Resco Products, Inc., Pittsburgh, Pa.). AA-22S typically comprises at least 80.0% $Al_2O_3$, 7.2% $SiO_2$, 1.0% $Fe_2O_3$, 4.8% MgO/CaO, 4.5% $P_2O_5$ in wt %. Micrographs of the eroded surface were electron microscopically taken to determine damage mechanisms. Table 4 summarizes the erosion loss of selected cermets as measured by the HEAT.

SUMMARY OF HEAT RESULTS

| Sample | Starting Weight (g) | Finish Weight (g) | Weight Loss (g) | Bulk Density (g/cc) | Erodant (g) | Erosion (cc/g) | Improvement [(Normalized erosion)$^{-1}$] |
|---|---|---|---|---|---|---|---|
| C310SS1100 | 246.6146 | 243.4477 | 3.1669 | 7.30 | 5.04E+5 | 8.6076E−7 | 1.2 |
| C310SS1150 | 247.5390 | 244.7651 | 2.7739 | 7.37 | 5.04E+5 | 7.4678E−7 | 1.4 |

The HEAT test measures very aggressive erodant particles. More typical particles are softer and cause lower erosion rates. For example FCCU catalysts are based on alumina silicates which are typically softer than aluminas which are typically much softer than SiC.

Example 5

Corrosion Testing

Each of the cermets of Examples 4 was subjected to an oxidation test. The procedure employed was as follows:

1) A specimen cermet of about 10 mm square and about 1 mm thick was polished to 600 grit diamond finish and cleaned in acetone.
2) The specimen was then exposed to 100 cc/min air at 800° C. in thermogravimetric analyzer (TGA).
3) Step (2) was conducted for 65 hrs at 800° C.
4) After 65 hours the specimen was allowed to cool to ambient temperature.
5) Thickness of oxide scale was determined by cross sectional microscopy examination of the corrosion surface.

The thickness of oxide scale was ranging about 0.5 μm to about 1.5 μm. The cermet composition exhibited a corrosion rate less than about $1\times10^{-11}$ $g^2/cm^4.s$ or an average oxide scale of less than 30 μm thickness when subject to 100 cc/min air at 800° C. for at least 65 hours. These represent superior corrosion resistance.

What is claimed is:

1. A process for preparing a composition gradient cermet material comprising the steps of:

in a first step, heating a metal alloy containing from 18 to 60 wt % chromium at a temperature in the range of about 600° C. to about 1150° C. in a hydrogen environment to form a heated metal alloy;

in a second step, exposing said heated metal alloy to a reactive carbon gaseous environment comprising $H_2$ and $CH_4$, wherein the $CH_4$ ranges from about 2 vol % to about 45 vol % in the range of about 600° C. to about 1150° C. for a time sufficient to provide a reacted alloy with a reacted layer of about 1.5 mm to about 30 mm thick on the surface or in the bulk matrix of the metal alloy; and in a third step, cooling said reacted alloy to a temperature below about 40° C. to provide a composition gradient cermet material, wherein one surface of the cermet is ceramic-rich and a second unexposed surface is metal-rich, and wherein said cooling step further comprises cooling said reacted alloy to a temperature in the range of 500° C. to 100° C., holding the temperature at any temperature in the range of 500° C. to 100° C. for a time period between 5 minutes to 10 hours and thereafter cooling at a rate in the range of 0.5° C. per second to 25° C. per second to below about 40° C.

2. The process of claim 1 wherein said metal alloy further comprises from 0 to 10 wt % titanium, and from 30 to 88 wt % of metals selected from the group consisting of iron, nickel, cobalt, silicon, aluminum, manganese, zirconium, hafnium, vanadium, niobium, tantalum, molybdenum, tungsten, and mixtures thereof.

3. The process of claim 1 wherein said metal alloy further comprises from 0 to 10 wt % titanium, and from 30 to 88 wt % iron.

4. The process of claim 1 wherein said exposing step is for a time period of about 1 hour to 800 hours.

5. The process of claim 1 wherein said exposing step is for a time period wherein the reacted alloy is of thickness encompassing the entire depth of said metal alloy.

6. The process of claim 1 wherein said cooling step comprises cooling said reacted alloy at a rate in the range of 0.5° C. per second to 25° C. per second.

7. The process of claim 1 wherein said exposing step is for a time period to provide a reacted alloy wherein said reacted alloy comprises precipitated chromium-rich carbides, titanium carbides and mixtures of chromium-rich and titanium carbides.

8. The process of claim 7 wherein said chromium-rich carbides comprise $Cr_7C_3$, $Cr_{23}C_6$ $(Cr_{0.6}Fe_{0.4})_7C_3$ $(Cr_{0.6}Fe_{0.4})_{23}C_6$ and mixtures thereof.

9. The process of claim 7 wherein said titanium carbides comprise TiC.

10. A process for preparing a composition gradient cermet material comprising the steps of:

in a first step, heating a metal alloy containing from 18 to 60 wt % chromium at a temperature in the range of about 600° C. to about 1150° C. in a hydrogen environment to form a heated metal alloy;

in a second step, exposing said heated metal alloy to a reactive nitrogen gaseous environment comprising $H_2$ and ammonia, wherein the ammonia ranges from about 2 vol. % to about 70 vol. % in the range of about 600° C. to about 1150° C. for a time sufficient to provide a reacted alloy with a reacted layer of about 1.5 mm to about 30 mm thick on the surface or in the bulk matrix of the metal alloy; and in a third step, cooling said reacted alloy to a temperature below about 40° C. to provide a composition gradient cermet material, wherein one surface of the cermet is ceramic-rich and a second unexposed surface is metal-rich, and wherein said cooling step further comprises cooling said reacted alloy to a temperature in the range of 500° C. to 100° C., holding the temperature at any temperature in the range of 500° C. to 100° C. for a time period between 5 minutes to 10 hours and thereafter cooling at a rate in the range of 0.5° C. per second to 25° C. per second to below about 40° C.

11. The process of claim 10 wherein said exposing step is for a time period to provide a reacted alloy wherein said reacted alloy comprises precipitated chromium-rich nitrides, titanium nitrides and mixtures of chromium-rich and titanium nitrides.

12. The process of claim 11 wherein said chromium-rich nitrides comprise $Cr_2N$.

13. The process of claim 11 wherein said titanium nitrides comprise TiN.

14. A process for preparing a composition gradient cermet material comprising the steps of:

in a first step, heating a metal alloy containing from 18 to 60 wt % chromium at a temperature in the range of about 600° C. to about 1150° C. in a hydrogen environment to form a heated metal alloy;

in a second step, exposing said heated metal alloy to a reactive carbon and nitrogen gaseous environment comprising $H_2$ and ammonia and $CH_4$, wherein the $CH_4$ ranges from about 2 vol % to about 45 vol % and the ammonia ranges from about 2 vol. % to about 70 vol. % in the range of about 600° C. to about 1150° C. for a time sufficient to provide a reacted alloy with a reacted layer of about 1.5 mm to about 30 mm thick on the surface or in the bulk matrix of the metal alloy; and in a third step, cooling said reacted alloy to a temperature below about 40° C. to provide a composition gradient cermet material, wherein one surface of the cermet is ceramic-rich and a second unexposed surface is metal-rich, and wherein said cooling step further comprises cooling said reacted alloy to a temperature in the range of 500° C. to 100° C., holding the temperature at any temperature in the range of 500° C. to 100° C. for a time period between 5 minutes to 10 hours and thereafter cooling at a rate in the range of 0.5° C. per second to 25° C. per second to below about 40° C.

15. A method for protecting a metal surface exposed to an erosive material at temperatures in the range of up to 850° C., the method comprising providing the metal surface with a cermet composition according to any one of claims 1, 10 or 14.

16. A method for protecting a metal surface exposed to an erosive material at temperatures in the range of 300° C. to 850° C., the method comprising providing the metal surface with a cermet composition according to claim 15.

17. The method of claim 15 wherein said surface comprises the inner surface of a fluid-solids separation cyclone.

* * * * *